United States Patent [19]

Stimson et al.

[11] Patent Number: 4,771,480

[45] Date of Patent: Sep. 20, 1988

[54] MAMMOGRAPHY CAPE

[75] Inventors: Betty T. Stimson; Mary M. Galloway, both of Winston-Salem, N.C.

[73] Assignee: Wake Forest University, Winston-Salem, N.C.

[21] Appl. No.: 936,287

[22] Filed: Dec. 1, 1986

[51] Int. Cl.[4] ..... A41D 3/08; A41D 13/12

[52] U.S. Cl. ..... 2/88; 2/DIG. 7

[58] Field of Search ..... 2/88, DIG. 7, 114, 50, 2/106, 69, 92, 104

[56] References Cited

U.S. PATENT DOCUMENTS

| | | | |
|---|---|---|---|
| D. 103,555 | 3/1937 | Spector | D2/179 |
| D. 118,219 | 12/1939 | Spanel | D2/179 |
| D. 127,647 | 6/1941 | Tucker | D2/179 |
| D. 152,661 | 2/1949 | Smith | D2/12 |
| D. 173,594 | 11/1954 | Stier | D2/179 |
| 1,220,088 | 3/1917 | Gavin | 2/88 |
| 1,272,942 | 7/1918 | Goldstein | 2/88 |
| 1,705,963 | 3/1929 | Clawson | 2/88 |
| 2,379,722 | 7/1945 | Kase | 2/50 |
| 2,417,888 | 3/1947 | Schuster | 2/104 |
| 2,479,246 | 8/1949 | Lupo | 2/114 |
| 2,698,944 | 1/1955 | Younghusband | 2/174 |
| 2,794,985 | 6/1957 | Brennish | 2/50 X |
| 2,808,591 | 10/1957 | Grant | 2/88 |
| 2,973,523 | 3/1961 | Brainard et al. | 2/114 X |
| 3,154,789 | 11/1964 | Lewis, Jr. | 2/114 |
| 4,025,961 | 5/1977 | Peters | 2/88 |
| 4,205,398 | 6/1980 | Blume | 2/114 |
| 4,608,719 | 9/1986 | Lunt | 2/114 |

OTHER PUBLICATIONS

Pp. 5 and 6 from Pro-Tex Mor catalog.

P. A-180 from American Hospital Supply catalog.

*Primary Examiner*—Werner H. Schroeder

*Attorney, Agent, or Firm*—Bell, Seltzer, Park & Gibson

[57] ABSTRACT

A mammography cape which permits the selective exposure of a breast by a subject during a mammography procedure or the like, while otherwise preventing unwanted body exposure, is disclosed. The cape is formed of drapable sheet material having a neck opening formed in the center thereof. The cape has a front and back portion of generally equal dimensions which are connected together only along a transverse center line. Both the front and back portions of the cape have distally spaced draping panels on opposite sides, the front and back draping panels cooperating together to conceal the upper torso of a wearer on both sides of the cape.

5 Claims, 1 Drawing Sheet

MAMMOGRAPHY CAPE

BACKGROUND OF THE INVENTION

Mammography procedures have become an important tool in the early diagnosis and effective treatment of breast cancer. To obtain the greatest benefit from this—and other—sophisticated technology, however, hospitals must seek to encourage prospective patients to take advantage of them by making their use as pleasant, or at minimum as least objectionable, as possible. To achieve this goal, some hospitals have instituted Patient Awareness Programs. These programs address the human side of the hospital experience by interviewing patients, identifying situations which the patients find personally objectionable, and taking the steps necessary to resolve the problem situations.

The present invention arose from a patient awareness program investigation into mammography examinations. This investigation revealed that patients undergoing such examinations usually wore either standard hospital gowns, which required the patient to expose herself from the waist up before and during the examination, or disposable paper vests which did little to preserve the privacy and dignity of the patient. In short, this research identified a need for a garment, specifically designed for use during mammography procedures or the like, which would be modest, comfortable, and attractive. Notwithstanding this need, applicants found no such garment available. An object of the present invention is, accordingly, to provide a modest and comfortable cape for use during mammography procedures and the like.

SUMMARY OF THE INVENTION

The mammography cape of the present invention permits selective exposure of a breast by a patient during a mammography procedure, or the like, while otherwise preventing unwanted body exposure. This cape, though simple in construction, is uniquely suited to its intended use.

The cape is formed of drapable sheet material of a predetermined shape and size, the sheet having a neck opening defined by a surrounding edge portion formed in the center thereof. The cape is adapted to be folded along a transverse center line extending widthwise through the middle of the cape, the center line dividing the cape into a front portion and a back portion of generally equal dimensions. These front and back portions are connected together only along the transverse center line.

The back portion of the cape has a back center panel at least about one foot wide, with the back center panel having a length substantially greater than its width, so that it is adapted to extend to about the waist of a wearer. The back portion also has a pair of distally spaced back draping panels extending along opposite sides of the back center panel. The draping panels extend from said transverse line a distance substantially the same as the length of the back center panel. The back draping panels collectively have a total width substantially greater than the back center panel.

The front portion of the cape similarly has a pair of distally spaced front draping panels substantially in longitudinal alignment with respective ones of said back draping panels. These front draping panels have a length and width substantially the same as the back draping panels. The front and back draping panels cooperate together to conceal the upper torso of a wearer on both sides of the cape, to permit the wearer to maintain her modesty. The front portion also has a pair of front center panels, which panels have a length substantially the same as the front draping panels. Each front center panel has one side connected to a side of one of said front draping panels, and an opposite side, defined by an inner edge portion, which extends longitudinally to the surrounding edge portion of the neck opening. Closure means are connected to the front portion of the cape for securing it in a closed position.

The front and back portions, by being unconnected along the sides of the cape, and the size and positional arrangement of the draping panels in the cape, together cause the draping panels to hang in folds down to about the waist of a wearer to permit selective body exposure in the course of a mammography procedure or the like, while otherwise preventing unwanted body exposure.

BRIEF DESCRIPTION OF THE DRAWINGS

The foregoing and other objects, features and advantages of the invention will be apparent from the following description of the preferred embodiments and the drawings, in which.

DETAILED DESCRIPTION OF THE PREFERRED EMBODIMENT

A mammography cape which is a preferred embodiment of the present invention is illustrated at 10 in FIGS. 1 through 4. The cape comprises drapable sheet material 11 formed of a woven fabric of a generally rectangular shape and predetermined size. The cape has a neck opening formed in the center of the sheet material, the neck opening being defined by a surrounding hemmed edge portion 16.

Figure 1:
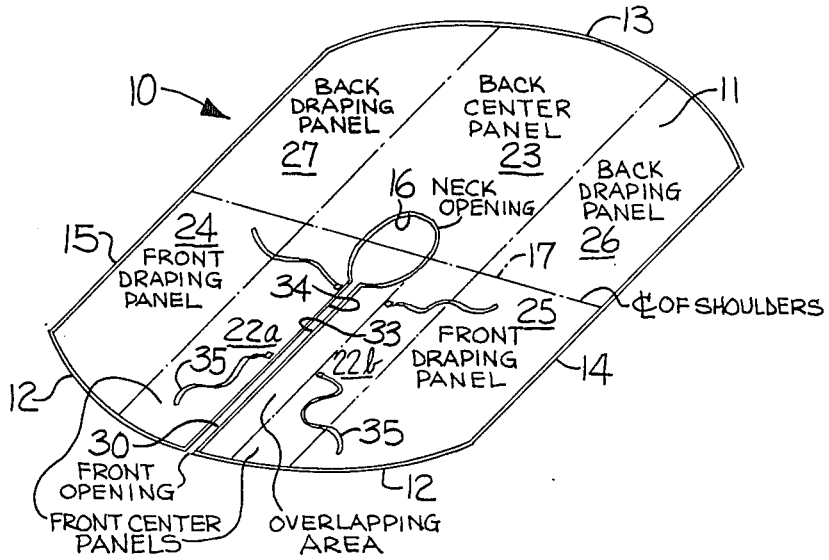
FIG. 1 is a perspective view of a mammography cape of the present invention.
Figure 2:
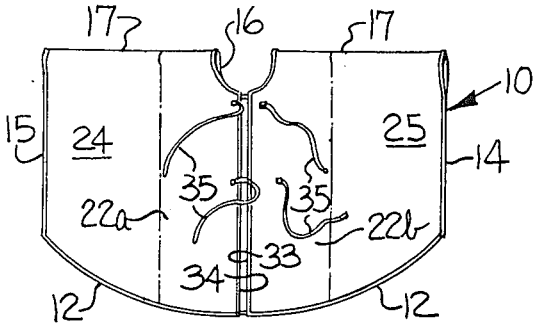
FIG. 2 is a front plan view of a mammography cape of the present invention folded along its transverse center line.

As best shown in FIG. 1, the cape is adapted to be folded along a transverse center line 17 extending widthwise through the middle of the cape, dividing the cape into a front portion and a back portion of generally equal dimensions. These front and back portions are connected together only along the transverse center line.

The front and back portions have hemmed side edge portions 14,15 which are substantially linear and parallel with one another. In addition, these front and back portions have convexly arcuate hemmed lower edge portions 12,13 which adapt the lower edge portions to hang generally evenly down to about the waist of a wearer, and thereby enhance the aesthetic appearance of the cape.

The back portion of the cape has a back center panel 23, which panel is at least about one foot wide, and has a length substantially greater than the width thereof. This panel is adapted to extend to about the waist of a wearer. The back portion of the cape also has a pair of elongate, distally spaced, back draping panels 26,27, extending along opposite sides of the back center panel, from the transverse center line 17 a distance substantially the same as the length of the back center panel 23. The pair of back draping panels collectively have a total width substantially greater than the back center panel.

Figure 3:
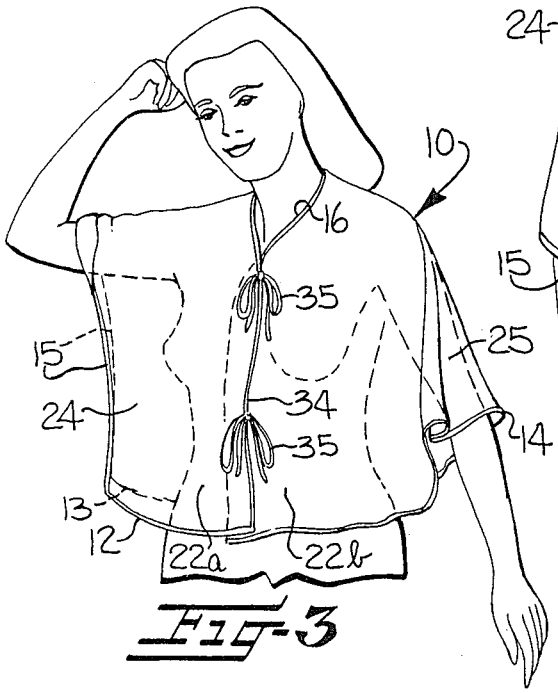
FIG. 3 illustrates a mammography cape of the present invention being worn by a subject.

The front portion of the cape has a pair of elongate, distally spaced, front draping panels 24,25 in substantially longitudinal alignment with respective ones of the back draping panels. The front draping panels have a length and width substantially the same as the back draping panels. As best shown in FIG. 3, the front and back draping panels cooperate together to conceal the upper torso of a wearer, on both sides of the cape, to permit the wearer to maintain her modesty.

The front portion of the cape also has a pair of front center panels 22*a*, 22*b*, each having a length substantially the same as the front draping panels. Each of the front center panels has one side connected to a side of one of the front draping panels, and an opposite side defined by a hemmed inner edge portion 33,34 extending longitudinally to the surrounding hemmed edge portion 16 of the neck opening.

Figure 4:
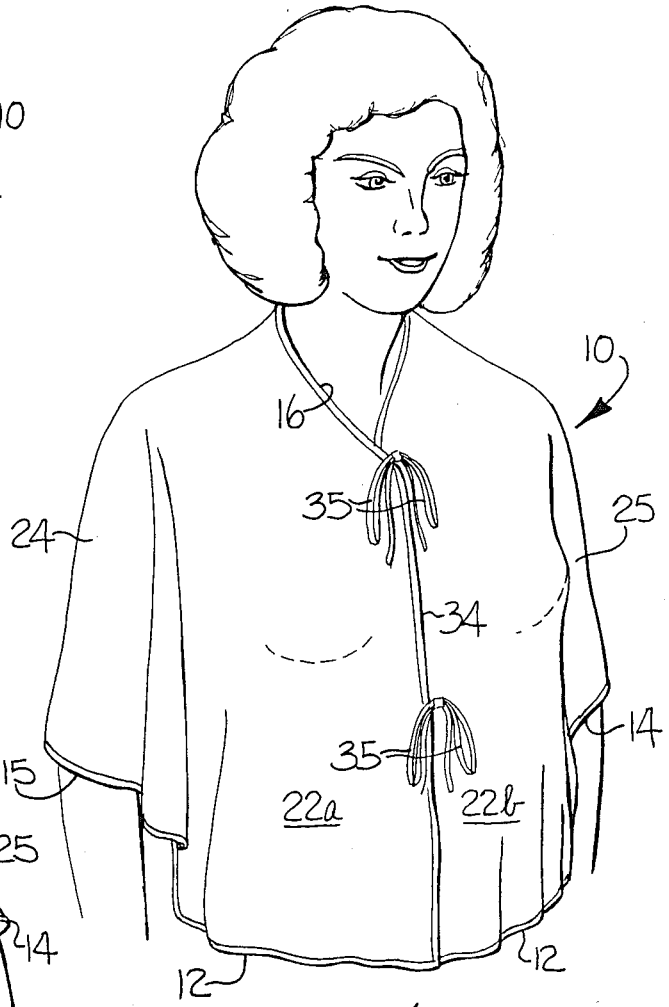
FIG. 4 is similar to FIG. 3, but illustrates more clearly how the side draping panels of the cape cooperate together to conceal the upper side torso of a wearer.

The cape has closure means having cooperating elements connected to the front center panels of the cape for securing the front portion of the cape in a closed position. More particularly, the cape has a plurality of elongate pliable strips 35 mounted on each respective front center panel 22*a*, 22*b* in opposing relation, with the plurality of strips on one front center panel (panel 22*b*, the left panel as illustrated) being positioned further away from its respective inner edge portion than the strips on the other front center panel are positioned from its respective inner edge portion. As shown in FIGS. 3 and 4, this causes the front center panels to partially overlap when the opposing strips are drawn toward each other and then tied together, to enhance the body concealment provided a wearer by the cape.

The cape is preferably made of a fabric which will be warm, soft and pliable next to the skin, and preferably will be washable in a hospital laundry system and hence reusable. Hospital laundries generally operate at a temperature of 180 degrees Fahrenheit, and recommend a woven fabric which has about 180 threads per square inch, and which is formed of yarns comprising a blend of cotton and polyester fibers for enhanced launderability of the cape. A woven fabric in which the blend of cotton and polyester fibers is comprised of 65% polyester fibers and 35% cotton fibers is preferred for the cape of the present invention. The fabric should be of an institutional, or pure, finish, with no resin. The elongate strips 35 are preferably textile fabric, comprising a blend of 50% polyester and 50% cotton, and are sewn to the front panels. All edge portions of the cape are hemmed. Thread should, if possible, be of a blend equivalent to the other materials from which the cape is made. The washing durability of a cape constructed of such materials, in a hospital laundry system, is expected to be about 150 washings.

In practice, the center panels are typically at least about 15 inches wide, and the draping panels are typically at least about 12 inches wide. A suitable cape measures about 56 inches lengthwise overall by about 41½ inches widthwise. The side edge portions in such a cape are shorter than the overall lengthwise dimension of the cape because of the curves in the front and back edge portions, and measure about 42 inches. Thus, each of the side edge portions has a length equaling about three-quarters of the overall length of the cape. Different sized capes can be made as needed.

The cape of the present invention is simple and inexpensive to construct. It is washable and reusable at little extra cost to a hospital laundry system. In use it is warm and comfortable, preserves the modesty of the wearer, and serves to make mammography procedures and the like less objectionable to patients.

A preferred embodiment of the invention has been disclosed in the drawings, and discussed with particularity above. Although specific terms are employed, they are used in a generic, descriptive sense only and not for purposes of limitation, the scope of the invention being set forth in the following claims.

That which is claimed is:

1. A mammography cape which permits the selective exposure of a breast by a subject during a mammography procedure or the like while otherwise preventing unwanted body exposure, the cape comprising an integrally formed drapable sheet material of a predetermined shape and size, a neck opening formed in the center of said sheet material, said neck opening defined by a surrounding edge portion, the cape being adapted to be folded along a transverse center line extending widthwise through the middle of the cape and dividing the cape into a front portion and a back portion of generally equal dimensions, said front and back portions being connected together only along said transverse center line, said back portion having a back center panel greater than one foot wide and a length substantially greater than the width thereof and adapted to extend to about the waist of a wearer, said back portion also having a pair of elongate distally spaced draping panels extending along opposite sides of the back center panel from said transverse line a distance substantially the same as the length of said back center panel, said pair of back draping panels collectively having a total width substantially greater than said back center panel, each back draping panel being at least about twelve inches wide, said front portion of said cape having a pair of elongate distally spaced front draping panels substantially in longitudinal alignment with respective ones of said back draping panels, said front draping panels having a length and width substantially the same as said back draping panels, said front and back portions have side edge portions which are substantially linear and aprallel with one another, said front and back portions having a lower edge portions defining a convex curve extending from one of said side edge portions to the other so as to adapt said lower edge portions to hang generally even down to about the waist of a wearer and thereby enhance the aesthetic appearance of the cape, each of said side edge portions having a length equalling about three-quarters of the overall length of said cape, said front and back draping panels cooperating together to conceal the upper torso of a wearer on both sides of the cape to permit the wearer to maintain her modesty, said front portion also having a pair of front center panels having a length substantially the same as said front draping panels, each of said front center panels having one side connected to a side of one of said front draping panels and an opposite side defined by an inner edge portion extending longitudinally to the surrounding edge portion of said neck opening, and closure means connected to the front portion of said cape for securing the front portion fo the cape in a closed position, whereby the front and back portions, by being unconnected along the sides of the cape, and the size and positional arrangement of the daping panels in the cape, together cause the draping panels to hang in folds down to about the waist of a wearer to permit selective body exposure in the course of a mammography procedure or the like, while otherwise preventing unwanted body exposure.

2. A mammography cape as claimed in claim 1, wherein said closure means comprise a plurality of elongate pliable strips mounted on each respective front center panel in opposing relation, with the plurality of strips on one front center panel being positioned further away from its respective inner edge portion than the strips on the other front center panel are positioned form its respective inner edge portion, so that front center panels partially overlap when said opposing strips are drawn toward each other and then tied together, to enhance the body concealment provided a wearer by said cape.

3. A mammography cape which may be repeatedly laundered and which permits the selective exposure of a breast by a subject during a mammography procedure or the like while otherwise preventing unwanted body exposure, the cape comprising an integrally formed drapable sheet material formed of a woven fabric of a predetermined shape and size, said woven fabric being formed of yarns having a blend of cotton and polyester fibers for enhanced launderability of the cape, a neck opening formed in the center of said sheet material, said neck opening defined by a surrounding hemmed edge portion, the cape being adapted to be folded along a transverse center line extending widthwise through the middle of the cape and dividing the cape into a front portion and a back portion of generally equal dimensions, said front and back portions being connected together only along said transverse center line, said back portion having a back center panel greater than one foot wide and a length substantially greater than the width thereof and adapted to extend to about the waist of a wearer, said back portion also having a pair of elongate distally spaced back draping panels extending along opposite sides of the back center panel from said transverse line a distance substantially the same as the length of said back center panel, said pair of back draping panels having hemmed outer edges, and collectively having a total width substantially greater than said back center panel, each of said back draping panels being at least about twelve inches wide, said front portion of said cape having a pair of elongate distally spaced front draping panels in substantially longitudinal alignment with respective ones of said back draping panels, said front draping panels having hemmed outer edges and a length and width substantially the same as said back draping panels, said front and back portions have side edges portions which are substantially linear and parallel ith one another, said front and back portions having lower edge portions defining a convex curve extending from one of said side edge portions to the other so as to adapt said lower edge portions to hang generally evenly down to about the waist of a wearer and thereby enhance the aesthetic appearance of the cape, each of said hemmed outer edges having a length equalling about three-quarters of the overall length of said cape, said front and back draping panels cooperating together to conceal the upper torso of a wearer on both sides of the cape to permit the wearer to maintain her modesty, said front portion also having a pair of front center panels having a length substantially the same as said front draping panels, each of said front center panels having one side connected to a side of one of said front draping panels and an opposite side defined by a hemmed inner edge portion extending longitudinally to the surrounding hemmed edge portion of said neck opening; and closure means having cooperating elements connected to said front center panels of said cape for securing the front portion of the cape in a closed position, whereby the front and back portions, by being unconnected along the sides of the cape, and the size and positional arrangement of the draping panels in the cape, together cause the draping panels to hang in folds down to about the waist of a wearer to permit selective body exposure in the course of a mammography procedure or the like, while otherwise preventing unwanted body exposure.

4. A mammography cape as claimed in claim 3, wherein said woven fabric has about 180 threads per square inch, and wherein said blend of cotton and polyester fibers is comprised of 65 polyester fibers and 35% cotton fibers.

5. A mammography cape which may be repeatedly laundered and which permits the selective exposure of a breast by a subject during a mammography procedure or the like while otherwise preventing unwanted body exposure, the cape comprising drapable sheet material formed of a woven fabric of a generally rectangular shape and predetermined size, said woven fabric being formed of yarns having a blend of cotton and polyester fibers for enhanced launderability of the cape, a neck opening formed in the center of said sheet material, said neck opening defined by a surrounding hemmed edge portion, the cape being adapted to be folded along a transverse center line extending widthwise through the middle of the cape and dividing the cape into a front portion and a back portion of generally equal dimensions, said front and back portions being connected together only along said transverse center line, said front and back portions having hemmed side edge portions which are substantially linear and parallel with one another, each of said side edge portions having a length equaling about three-quarters of the overall length of said cape, and said front and back portions having convexly arcuate lower edge portions extending from one of said side edge portions to the other and which adapt said lower edge portions to hang generally evenly down to about the waist of a wearer and thereby enhance the aesthetic appearance of the cape, said back portion having a back center panel at least about one foot wide and a length substantially greater than the width thereof and adapted to extend to about the waist of a wearer, said back portion also having a pair of elongate distally spaced back draping panels extending along opposite sides or the back center panel from said transverse line a distance substantially the same as the length of said back center panel, said pair of back draping panels collectively having a total width substantially greater than said back center panel, each back draping panel being at least about twelve inches wide, said front portion of said cape having a pair of elongate distally spaced front draping panels in substantially longitudinal alignment with respective ones of said back draping panels, said front draping panels having a length and width substantially the same as said back draping panels, said front and back draping panels cooperating together to conceal the upper torso of a wearer on both sides of the cape to permit the wearer to maintain her modesty, said front portion also having a pair of front center panels having a length substantially the same as said front draping panels, each of said front center panels having one side connected to one of said front draping panels and an opposite side defined by a hemmed inner edge portion extending longitudinally to the surrounding hemmed edge portion of said neck opening; and closure means comprising a plurality of elongate textile fabric strips mounted on each respective front center panel in opposing relation, with the plurality of strips on one front center panel being positioned further away from its respective inner edge portion than the strips on the other front center panel are positioned from its respective inner edge portion, so that said front center panels partially overlap when said oppositing strips are drawn toward each other and then tied together, to enhance the body concealment provided a wearer by said cape, whereby the front and back portions, by being unconnected along the sides of the cape, and the size and positional arrangement of the draping panels in the cape, together cause the draping panels to hang in folds down to about the waist of a wearer to permit selective body exposure in the course of a mammography procedure or the like while otherwise preventing unwanted body exposure.

* * * * *